US006385889B1

(12) United States Patent
Zaharek

(10) Patent No.: US 6,385,889 B1
(45) Date of Patent: May 14, 2002

(54) GUN LOCK ASSEMBLY

(76) Inventor: Richard L. Zaharek, 105 Highfield Dr., Torrington, CT (US) 06790

( * ) Notice: Subject to any disclaimer, the term of this patent is extended or adjusted under 35 U.S.C. 154(b) by 0 days.

(21) Appl. No.: 09/802,259

(22) Filed: Mar. 8, 2001

(51) Int. Cl.[7] ..... F41A 17/44
(52) U.S. Cl. ..... 42/70.11; 42/70.07
(58) Field of Search ..... 42/70.01, 70.07, 42/70.11

(56) References Cited

U.S. PATENT DOCUMENTS

| | | | | |
|---|---|---|---|---|
| 2,479,107 A | | 8/1949 | Gareston | 42/70.01 |
| 3,368,297 A | * | 2/1968 | Lentz | 42/70.11 |
| 4,398,366 A | | 8/1983 | Wernicki | 42/70.11 |
| 5,048,211 A | | 9/1991 | Hepp | 42/70.11 |
| 5,241,770 A | | 9/1993 | Lambert | 42/70.11 |
| 5,271,174 A | * | 12/1993 | Bentley | 42/70.11 |
| 5,412,959 A | | 5/1995 | Bently | 70/30 |
| 6,041,536 A | | 3/2000 | Samuels | 42/70.11 |

FOREIGN PATENT DOCUMENTS

| | | | |
|---|---|---|---|
| DE | 378767 | * 12/1922 | 42/70.11 |

* cited by examiner

*Primary Examiner*—Stephen M. Johnson

(57) ABSTRACT

A gun lock assembly formed of two major components, a chamber blocking rod member and a locking rod member. The chamber blocking rod member has a shank portion that is longer than the gun barrel to be blocked and a 90 degree extension terminating in a closed loop. The locking rod member has an open end and and a locking aperture end. The opening in the open loop is of sufficient width to accept the smaller of the cross sectional dimensions of the the trigger guard and the locking aperture end is sized to be introduced into the closed loop of the blocking rod member. The open loop of the locking rod is assembled to the trigger guard and the locking end is introduced into the closed loop and locked. The blocking rod member can not be removed without unlocking and removing the lock.

3 Claims, 2 Drawing Sheets

5
10
15
D2

5
D2

5
15
10
20
10
15

45
60
30
45
25

30

GUN LOCK ASSEMBLY

BACKGROUND—FIELD OF INVENTION

This invention relates to gun locks and more specifically to gun chamber blocking locks.

BACKGROUND—DESCRIPTION OF PRIOR ART

A major concern of gun owners and law enforcement officials is the fact children may gain unauthorized access to loaded guns with the consequence of someone being injured or killed. There is also concern that a gun owner may accidentally drop a loaded gun causing an unintentional discharge of the weapon.

Presently there are gun lock devices on the market that have not been entirely satisfactory. Some of these lock into the trigger guard behind the trigger thereby preventing the trigger being pulled. This device does not insure that there is not a live bullet in the chamber, which can cause unintentional discharge of the firearm should it be dropped or handled improperly. There are several cable lock devices in which the chamber is partially blocked or in the case of revolver the cylinder is locked out of position. In either case a live bullet can not be loaded into the chamber but the firearm has to be left open allowing debris to invade the barrel, chamber or the cylinder of the firearm.

ROCKY MOUNTAIN TOOL & ARMORY offers a gun lock that prevents loading live ammunition into the chamber but each gun lock of this design will fit only one caliber hand gun and barrel length and is relatively expensive to manufacture.

Inventors have created several chamber blocking gun locks to prevent the loading of live ammunition into the chamber with the lock installed. U.S. Pat. No. 5,412,959 to Bentley (1995) discloses a chamber blocking gun lock that requires a different length chamber blocking rod and a different length mounting cable for each barrel length. U.S. Pat. No. 2,479,107 (1949) to Garrison teaches a chamber blocking gun lock with a locking chamber blocking rod. This gun lock can be applied single caliber firearm with a single barrel length only. The same limitations apply to U.S. Pat. Nos. 5,048,211 and 4,398,366 issued to Hepp and Wernicki respectively and to international publication number WO 00/17596 to Hutton. U.S. Pat. No. 6,041,536 to Samuels teaches a chamber blocking gun lock to be used on a single caliber revolver only.

SUMMERY

In accordance with the present invention a gun lock assembly comprises an elongated chamber blocking rod member having a 90 degree extension having a formed closed loop at the end thereof; a locking rod having an open loop at the end thereof, said loop engaging the trigger guard of the firearm to be locked. The opposite end of said locking rod, having a series of radial apertures, is introduced into the closed loop of said blocking rod and is locked in place by the insertion of a commercially available pad lock into the appropriate radial apertures of said locking rod.

OBJECTS AND ADVANTAGES

Accordingly, several objects and advantages of the present invention are:

(a) to provide a chamber blocking gun lock being economical to manufacture and easy to install;

(b) to provide a chamber blocking gun lock suitable for installation on firearms if different caliber and barrel length;

(c) to provide a chamber blocking gun lock that cannot be removed by a child without the proper key or lock combination; and (d) to provide a chamber blocking gun lock that prevents accidental firing of a loaded firearm due to mishandling or dropping of the firearm.

Further objects and advantages will become apparent from consideration of the ensuing description and drawings.

DRAWING FIGURES

REFERENCE NUMERALS IN DRAWING

| | |
|---|---|
| 5 chamber blocking rod | 35 trigger guard |
| 10 90 degree extension of blocking rod | 40 locking means combination lock |
| 15 closed loop | 45 locking rod |
| 20 rearward extension of blocking rod | 50 ghost image of firearm |
| 25 radial apertures on locking rod | 55 gun lock assembly |
| 30 open loop on locking rod | D1 referenced distance for various barrel length applications |
| D3 length of gun barrel | D2 length of shank portion of chamber blocking rod |

DESCRIPTION OF THE PREFERRED EMBODIMENT

The novel chamber blocking gun lock will now be described by referring to FIGS. 1–4. The gun lock assembly is designated numeral 55 and its primary components are chamber blocking rod 5 and locking rod 45.

Figures 1, 2, 3, 5:
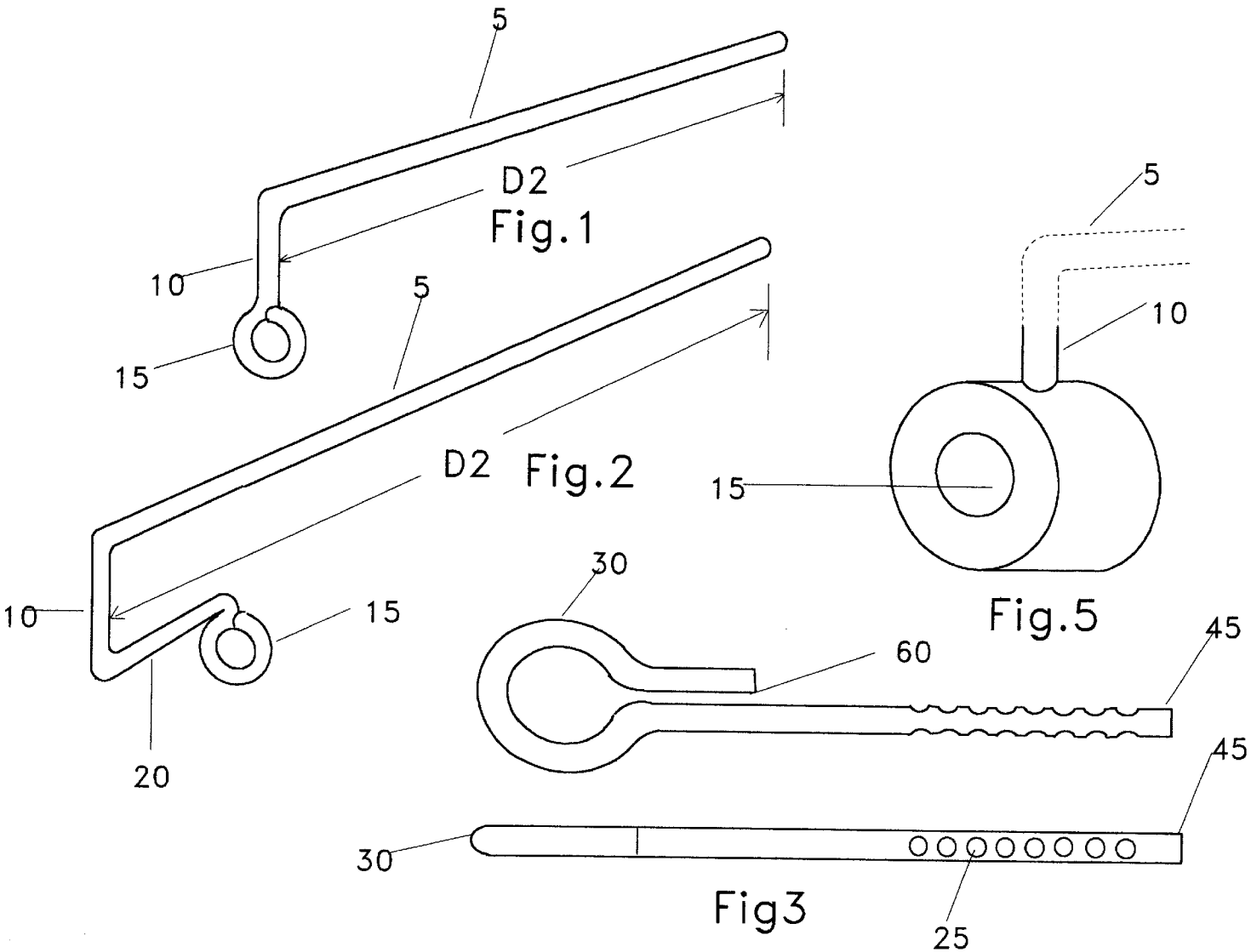
FIG. 1 shows a chamber blocking rod for firearms with relatively short barrel lengths.
FIG. 2 shows a chamber blocking rod for firearms with relatively longer barrel length.
FIG. 3 shows two views of the locking rod.
FIG. 5 illustrates an alternative structure for closed loops on the chamber blocking rod.
Figure 4A:
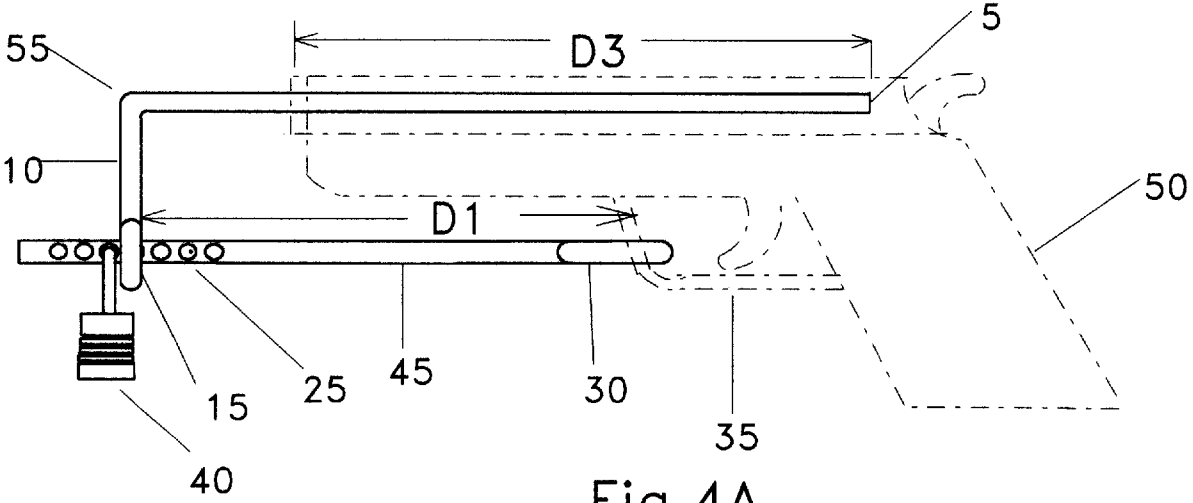
FIG. 4A shows the chamber blocking gun lock installed on a relatively short barreled firearm.
Figure 4B:
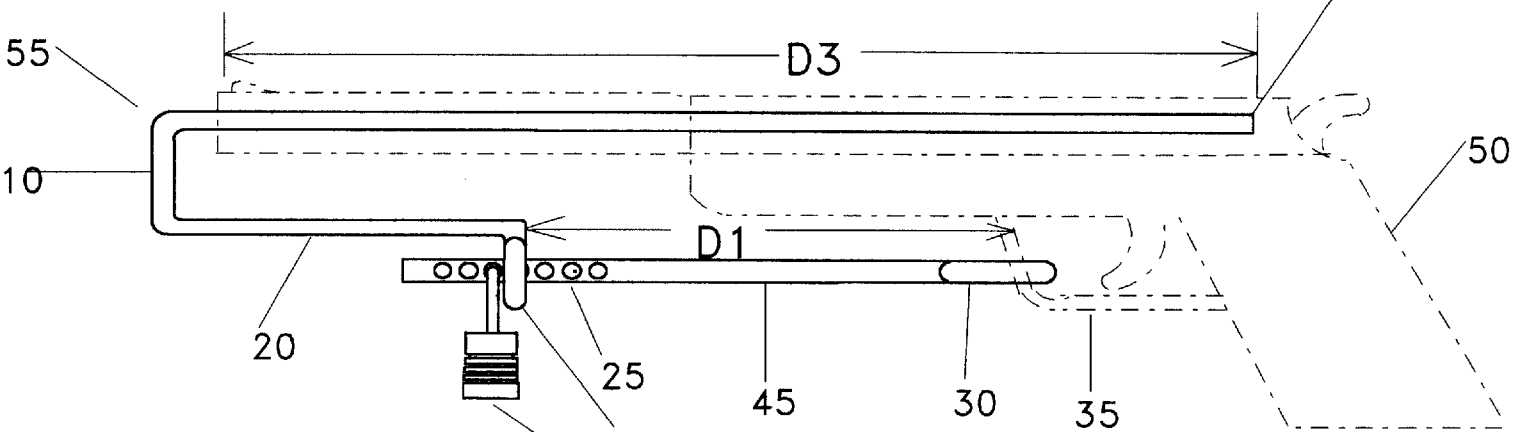
FIG. 4B shows the chamber blocking gun lock installed on a relatively long barreled firearm.

In FIG. 4A the schematic illustration of the chamber blocking gun lock 55 assembled to a gun 50 with a relatively short barrel D3 In FIG. 4A the chamber blocking rod 5 has a simple 90 degree extension 10 terminating with a closed loop 15 establishing a reference distance D1 from the front of the trigger guard 35 to the closed loop 15. In FIG. 4b is a schematic illustration of the chamber blocking gun lock 55 assembled to a gun 50 with a relatively long barrel D3. In FIG. 4B the chamber blocking rod 5 has a 90 degree extension 10 having a rearward projecting extension 20 ending in a closed loop 30 in a plane perpendicular to the axis of extension 20. The length of extension 20 is designed to establish the same reference distance D1 from the front of trigger guard 35 to the closed loop 15 in FIG. 4B as in FIG. 4A. Locking rod 45 having an open loop 30 with opening 60 of sufficient width to accept the smaller dimension of the trigger guard 35 cross section and having a series of radial apertures 25 to accept the hasp of locking means 40.

Although the present invention has been described herein with respect to preferred embodiments, it will be understood that the foregoing descriptions intended to be illustrative, not restrictive. Modifications of the present invention will occur to those skilled in the art. All such modifications which fall within the scope of the appended claims are intended to be within the scope and spirit of the present invention.

I claim:

1. A gun lock assembly in combination with a gun having a gun barrel having a breach end and a muzzle end, said gun having a trigger guard having a central aperture, comprising: a chamber blocking rod member having a muzzle end and a breach end, a shank portion extends rearward from said muzzle end and has a predetermined length D2 which would be inserted into the said muzzle end of said gun barrel, a 90 degree extension of the muzzle end of said chamber blocking rod member terminates with a closed loop; a locking rod member having an open loop end and a locking end said open loop end of said locking rod member being removably assembled to said trigger guard and said locking end being inserted into said closed loop of said chamber blocking rod member; and means for locking said end of said locking rod member after it has been inserted into said closed loop of said chamber blocking means.

2. A gun lock assembly as recited in claim 1 wherein said means for locking said locking rod member is a combination lock.

3. A gun lock assembly as recited in claim 1 wherein the distance from the muzzle end of the said gun barrel to the breach end of said gun barrel is D3; and the D2 length of the shank portion of the said chamber blocking rod member is greater than the said gun barrel length D3.

* * * * *